US006347927B1

(12) United States Patent
Nakane et al.

(10) Patent No.: US 6,347,927 B1
(45) Date of Patent: Feb. 19, 2002

(54) PISTON-TYPE COMPRESSOR WITH BOLTED SEPARATING WALL

(75) Inventors: Yoshiyuki Nakane; Shinya Yamamoto, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/630,269

(22) Filed: Aug. 1, 2000

(30) Foreign Application Priority Data

Sep. 29, 1999 (JP) ..... 11-275971

(51) Int. Cl.[7] ..... F04B 1/12

(52) U.S. Cl. ..... 417/269; 417/222.2; 91/499; 92/12.2

(58) Field of Search ..... 417/269, 222.2; 91/499; 92/12.2

(56) References Cited

U.S. PATENT DOCUMENTS 4,641,570 A * 2/1987 Futamura et al. ..... 417/269
5,061,155 A * 10/1991 Masaoka et al. ..... 417/269
5,685,160 A 11/1997 Abersfelder et al.
6,026,731 A * 2/2000 Hinrichs et al. ..... 92/12.2
6,158,974 A * 12/2000 Tarutani et al. ..... 417/269

FOREIGN PATENT DOCUMENTS

JP A 5-187356 7/1993
JP A 11-223179 8/1999

* cited by examiner

*Primary Examiner*—Cheryl J. Tyler
(74) *Attorney, Agent, or Firm*—Woodcock Washburn LLP

(57) ABSTRACT

A piston-type compressor includes a cylinder block having cylinder bores and a rear housing having a separating wall to divide the interior of the rear housing into a suction chamber and a discharge chamber. Pistons are arranged in the cylinder bores to reciprocate therein. Bolts are inserted in the cylinder block and extend into the separating wall of the rear housing to connect the cylinder block and the housing together. Since the separating wall is forced to the cylinder block by the bolts, no leakage occurs between the suction chamber and the discharge chamber.

10 Claims, 2 Drawing Sheets

PISTON-TYPE COMPRESSOR WITH BOLTED SEPARATING WALL

BACKGROUND OF THE INVENTION

1. Field of the Invention

The present invention relates to a piston-type compressor and, more specifically, to a piston-type compressor which features an improved sealing performance between a suction chamber and a discharge chamber to decrease internal leakage. The piston-type compressor of the invention can be favorably used in a refrigerating device such as vehicle air conditioner.

2. Description of the Related Art

As a piston-type compressor (hereinafter simply referred to as "compressor") used for a refrigerating device in a vehicle air conditioner, there has heretofore been known the one comprising a cylinder block forming cylinder bores therein and a housing having a suction chamber and a discharge chamber formed therein and separated by a separating wall.

In this compressor, the piston reciprocates in the cylinder bore, whereby a low-pressure coolant fed back into the suction chamber from the out side is taken into the cylinder bore and is compressed, and is, then, discharged as a high-pressure coolant into the discharge chamber.

In this compressor, when the sealing performance is not sufficient between the suction chamber and the discharge chamber, i.e., when the sealing performance is not sufficient at the end surface of the separating wall that separates the suction chamber and the discharge chamber from each other, there occurs internal leakage in that the high-pressure coolant leaks from the discharge chamber into the suction chamber through the gap at the end surface of the separating wall when the high-pressure coolant compressed in the cylinder bore is discharged into the discharge chamber, resulting in a drop in the performance of the compressor.

In particular, the above-mentioned problem becomes conspicuous in a refrigerating device (hereinafter suitably referred to as "supercritical cycle refrigerating device") which so works that the pressure of the high-pressure side (discharge pressure of the compressor) in a closed circuit constituting the refrigerating device becomes a supercritical pressure of the coolant.

That is, in a compressor in the supercritical cycle refrigerating device disclosed in, for example, Japanese Unexamined Patent Publication (Kokai) No. 8-110104, the coolant gas is compressed up to a pressure that exceeds the supercritical pressure of the coolant. For example, when carbon dioxide, of which the critical pressure is about 7.35 MPa, is used as the coolant, the compressor compresses the coolant gas up to a pressure of about 10 MPa. When a freon-type coolant is used as the coolant or, in other words, in a refrigerating device (hereinafter suitably referred to as "subcritical cycle cooling device") which so works that both the discharge pressure and the suction pressure are smaller than the critical pressure of the coolant, the discharge pressure of the compressor is about 1 to about 3 MPa. Thus, the discharge pressure of the compressor in the supercritical cycle cooling device is very much higher than that of the subcritical cycle refrigerating device. In the compressor of the supercritical cycle refrigerating device, therefore, there tends to occur a problem of internal leakage since the blow-out pressure is high.

SUMMARY OF THE INVENTION

The present invention is made in view of the above-mentioned circumstances, and the object of the present invention is to reduce internal leakage by improving the sealing performance between a suction chamber and a discharge chamber, and to suppress a drop in the performance of the compressor caused by internal leakage.

According to the present invention, there is provided a piston-type compressor comprising: a cylinder block having cylinder bores; a housing joined to the cylinder block and having an interior and a separating wall to divide the interior into a suction chamber and a discharge chamber; pistons reciprocatingly arranged in the cylinder bores; a rotatable drive shaft; a compression mechanism rotatable with the shaft to cause the pistons to reciprocate in the cylinder bores so that a low pressure coolant is sucked from the suction chamber into the cylinder bores and a high pressure coolant is discharged from the cylinder bores into the discharge chamber; and bolts extending in the separating wall of the housing to fasten the cylinder block and the housing together.

In this compressor, the cylinder block and the housing are fastened together by bolts extending in the separating wall of the housing. Therefore, the fastening force of bolts are directly exerted on the separating wall, enabling the end surface of the separating wall of the housing to be reliably forced to the cylinder block. This enhances sealing performance at the end surface of the separating wall and, hence, enhances sealing performance between the suction chamber and the discharge chamber separated by the separating wall. This decreases internal leakage in that the high-pressure coolant flows into the suction chamber through the end surface of the separating wall as it is compressed in the cylinder bore by the reciprocal motion of the piston in the cylinder bore and is discharged into the discharge chamber. This, accordingly, suppresses a drop in the performance of the compressor caused by internal leakage.

The sealing performance at the end surface of the separating wall can be further enhanced by bolts extending in the separating wall of the housing, so the internal leakage can be decreased even without using a gasket on the end surface of the housing.

Preferably, the separating wall is shaped in an annular form, the discharge chamber being formed inside the separating wall, the suction chamber being formed outside the separating wall.

In this compressor, the discharge chamber is formed inside the separating wall that is reliably sealed by bolts, preventing the high-pressure coolant in the discharge chamber from leaking to the outer side through the separating wall and, hence, suppressing not only internal leakage but also reliably preventing the high-pressure coolant from leaking to the outer side of the compressor. This makes it possible to omit not only the gasket that maintains sealing on the surface where the cylinder block and the housing are abutted to each other but, depending upon the cases, also the bolts that are used for maintaining the sealing between the outer peripheral side walls of the cylinder block and the housing. Omission of these parts makes it possible to decrease the cost.

Preferably, the housing comprises a front housing joined to a front side of the cylinder block and rotatably supporting the drive shaft, and a rear housing joined to a rear side of the cylinder block and having the separating wall, the front housing and the cylinder block forming a crank chamber therein, each of the bolts having a head arranged on the cylinder block in the crank chamber and a threaded end engaged in a corresponding threaded hole in the separating wall of the rear housing.

In this compressor, since the heads of the bolts exist in the crank chamber, the high-pressure coolant that may leak from the discharge chamber through bolts and bolt holes stays in the crank chamber which is basically a sealed space, and does not leak to the outside of the compressor. Therefore, even if washers for maintaining the sealing between the bolts and the bolt holes are omitted, the high-pressure coolant does not leak from the discharge chamber to the outside of the compressor. Omission of the washers makes it possible to decrease the cost.

Preferably, the piston is a single-headed piston and the compression mechanism, including a swash plate supported by the drive shaft, is arranged in the crank chamber so that the swash plate is inclined with respect to the drive shaft and rotatable with the drive shaft.

Preferably, the coolant is discharged at a supercritical pressure of the coolant.

Preferably, the coolant is carbon dioxide.

When the compressor discharges the coolant at a supercritical pressure, there easily occurs the problem of internal leakage as described above. Concerning this point, in this compressor as described above, the internal leakage is suppressed by improving the sealing performance between the suction chamber and the discharge chamber separated by the separating wall by using bolts extending in the separating wall of the housing. Therefore, even when the compressor discharges the coolant at the supercritical pressure, it is possible to suppress a drop in the performance of the compressor caused by the internal leakage.

Preferably, the compressor further comprises a valve plate between the cylinder block and the rear housing, the bolts extending through the valve plate.

Preferably, the separating wall has thick wall portions along the annular form thereof, the threaded holes being arranged in the thick wall portions.

Preferably, the compressor further comprises a second set of bolts extending from the front housing to the rear housing to connect the front housing, the cylinder block and the rear housing together.

Preferably, the first set of bolts are arranged at a first angular pitch, and the second set of bolts are arranged at a second angular pitch identical to the first angular pitch and on the radially outer side of the first set of bolts.

BRIEF DESCRIPTION OF THE DRAWINGS

The present invention will become more apparent from the following description, of the preferred embodiments, with reference to the accompanying drawings in which.

DESCRIPTION OF THE PREFERRED EMBODIMENT

An embodiment of the invention will now be described with reference to the drawings.

Figure 1:
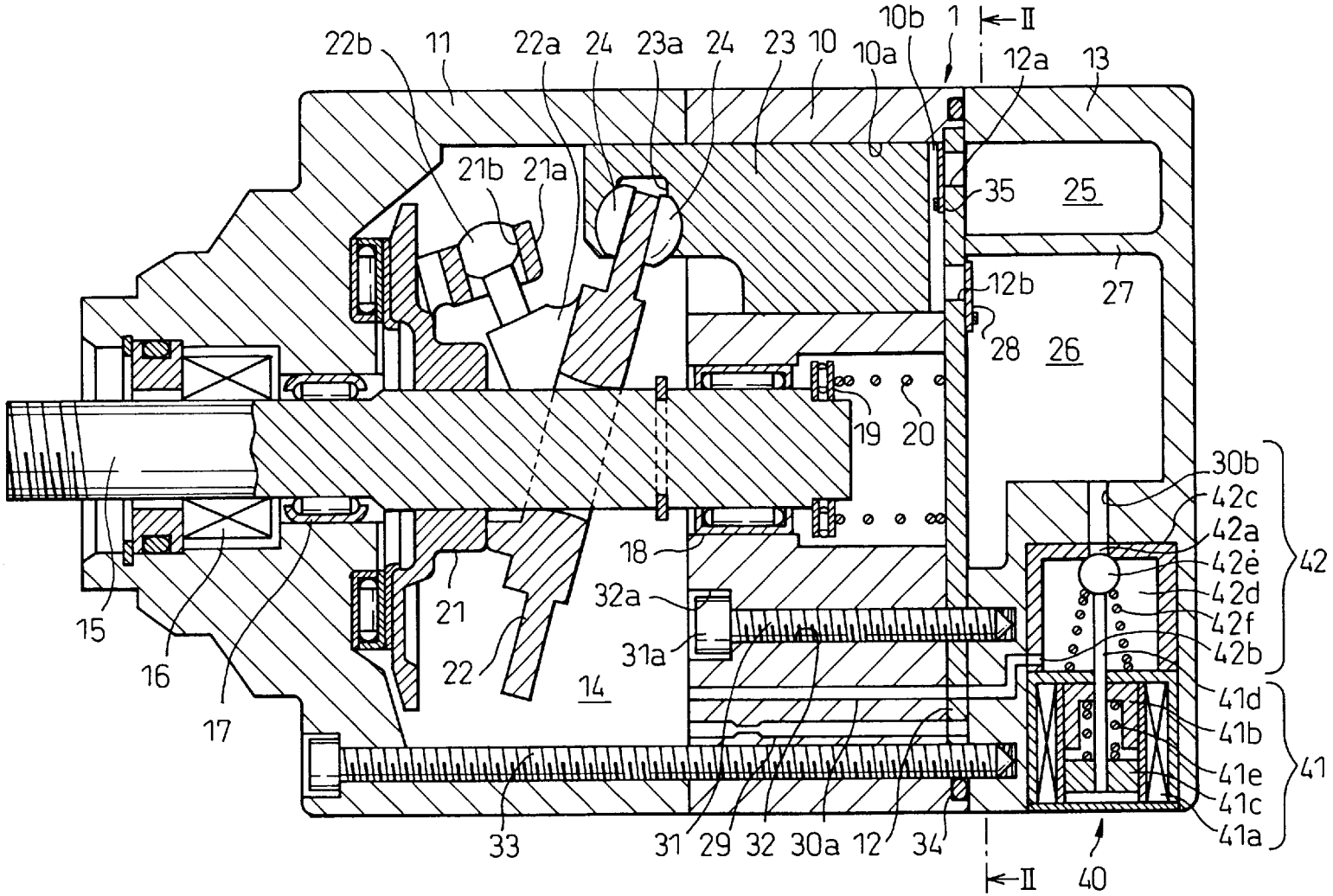
FIG. 1 is a longitudinal cross-sectional view of a compressor according to the embodiment of the present invention.

The compressor 1 shown in FIG. 1 is used in a refrigerating device for a vehicle air conditioner, which is constituted as a supercritical cycle refrigerating device. That is, the refrigerating device comprises a closed circuit in which a compressor 1, a gas cooler as a heat-radiating heat exchanger (not shown), an expansion valve as a throttle means, an evaporator as a heat exchanger for absorbing heat, and an accumulator as a gas-liquid separator are connected in series, and the discharge pressure of the compressor (pressure of the high-pressure side of the circuit) is a supercritical pressure of the coolant that circulates through the circuit. Carbon dioxide ($CO_2$) is used as the coolant. The coolant may be ethylene ($C_2H_4$), diborane ($B_2H_6$), ethane ($C_2H_6$) or nitrogen oxide in addition to carbon dioxide ($CO_2$).

In this compressor 1, a front housing 11 is joined to the front end of a cylinder block 10, and a rear housing 13 is joined to the rear end of the cylinder block 10 via a valve plate 12 sandwiched therebetween. A crank chamber 14, which is formed by the front housing 11 and the cylinder block 10, accommodates a drive shaft 15 having one end extending beyond the front housing 11 and secured to an armature of an electromagnetic clutch (not shown). The drive shaft 15 is rotatably supported by a shaft-sealing device 16 and by radial bearings 17 and 18 provided in the front housing 11 and in the cylinder block 10. A thrust bearing 19 and a spring 20 are interposed between the other end of the drive shaft 15 and the valve plate 12.

In the crank chamber 14, a rotary support member 21 is secured to the drive shaft 15 and a thrust bearing is arranged between the front housing 11 and the member 21 so that the member is rotatable in synchronism with the drive shaft 15. The rotary support member 21 has a pair of support arms 21*a* (one of them is shown) at the rear portion of the peripheral edge thereof. The arms 21*a* have guide holes 21*b*, respectively. The drive shaft 15 supports a swash plate 22 so that it is allowed to incline and slide in the axial direction of the drive shaft 15. A coupling piece 22*a* is provided in the swash plate 22, and a pair of guide pins 22*b* are attached to the end of the coupling piece 22*a*. The guide pins 22*b* are engaged in the respective guide holes 21*b* of the rotary support member 21, and the guide holes 21 guide the inclination of the swash plate 22 through the guide pin 22*b*. Due to the guide action and the support action of the drive shaft 15, the swash plate 22 swings in the direction of the drive shaft 15 and rotates in synchronism with the drive shaft 15.

Five cylinder bores 10*a* are provided in the cylinder block 10 at positions around the drive shaft 15, and single-headed pistons 23 are accommodated in the cylinder bores 10*a* to reciprocate therein. A pair of front and rear shoes 24 and 24 are interposed between a neck portion 23*a* of the piston 23 and the swash plate 22. The rotational motion of the swash plate 22, which is supported by the drive shaft 15 so as to rotate in synchronism therewith and to incline at a predetermined angle, is transformed into a back-and-forth reciprocating motion of the piston 23 via the shoes 24 and 24, and the piston 23 reciprocates in the cylinder bore 10*a*.

The rear housing 13 has a separating wall 27 to divide the interior of the rear housing into a suction chamber 25 and a discharge chamber 26. The suction chamber 25 is formed outside the separating wall 27, and the discharge chamber 26 is formed inside the separating wall 27. The suction chamber 25 is communicated with compression chambers 10*b* of the cylinder bores 10*a* through suction holes 12*a* formed in the valve plate 12, and the discharge chamber 26 is communicated with the compression chambers 10*b* of the cylinder bores 10*a* through discharge holes 12*b* formed in the valve plate 12. Each suction hole 12*a* is opened and closed by each suction valve 35 which is a reed valve attached to the valve plate 12, and each discharge valve 12*b* is opened and closed by each discharge valve 28 which also is a reed valve attached to the valve plate 12. The suction chamber 25 is connected, via a conduit, to an accumulator that is part of a refrigerating circuit of the refrigerating device, and the discharge chamber 26 is connected, via a conduit, to a gas cooler that is part of the refrigerator circuit of the cooling device.

In the cylinder block 10, the valve plate 12 and the rear housing 13, there are formed an extraction passage 29 for communicating the crank chamber 14 with the suction chamber 25, and supply passages 30*a* and 30*b* working as control passages for communicating the crank chamber 14 with the discharge chamber 26. In the rear housing 13, a control valve 40 is provided between the supply passages 30*a* and 30*b*.

The control valve 40 includes a solenoid 41 and a valve mechanism 42. The solenoid 41 includes a coil 41*a*, a fixed iron core 41*b*, a movable iron core 41c, a drive rod 41*d* secured to the movable iron core 41*c*, and a spring 41*e*. The valve mechanism 42 includes a frame 42*c* having a valve hole 42*a* and a port 42*b*, a valve body 42*e* held in a valve chamber 42*d* in the frame 42*c*, and a spring 42*f* for holding the valve body 42*e*. Upon feeding an electric current to the coil 41*a*, the movable iron core 41*c* is attracted by, and moves toward, the fixed iron core 41*b*. That is, the drive force of the solenoid 41 is transmitted to the valve body 42*e* via the drive rod 41*d*, whereby the valve body 42*e* is urged in a direction to close the valve hole 42*a*. A return spring 41*e* urges the movable iron core 41*c* in a direction to move away from the fixed iron core 41*b*.

The valve chamber 42*d* is communicated with the crank chamber 14 through the port 42*b* and supply passage 30*a*, and is communicated with the discharge chamber 26 through the valve hole 42*a* and supply passage 30*b*. That is, when the valve body 42*e* is at a position to open the valve hole 42*a*, the high-pressure coolant in the discharge chamber 26 is sent to the crank chamber 14 through supply passage 30*b*, the valve hole 42*a*, the valve chamber 42*d*, the port 42*b* and the supply passage 30*a*.

The sum of a drive force F0 of the solenoid 41 and of a resilient force F2 of the spring 42*f*, opposes the sum of the entire pressure Pd1 of a discharge pressure Pd acting on the valve body 42*e* and a resilient force F1 of the spring 41*e*. That is, when the entire pressure Pd1 of the discharge pressure Pd exceeds (F0+F2−F1), the valve body 42*e* opens the valve hole 42*a*, and the high-pressure coolant in the discharge chamber 26 flows into the crank chamber 14. When the entire pressure Pd1 of the discharge pressure Pd does not exceed (F0+F2−F1), the valve body 42*e* closes the valve hole 42*a*, and the high-pressure coolant in the discharge chamber 26 does not flow into the crank chamber 14. That is, the control valve 40 controls the supply of coolant from the discharge chamber 26 into the crank chamber 14, and maintains the discharge pressure Pd constant. The control valve 40 is controlled by a controller that is not shown. The controller determines the discharge capacity of the compressor based, for example, upon external data such as the temperature detected in the compartment, the target temperature to be set, etc., and controls the supply of current to the solenoid 41 of the control valve 40 in response thereto.

In this compressor, therefore, the piston 23 reciprocates in the cylinder bore 10*a* accompanying the rotation of the drive shaft 15, whereby the low-pressure coolant from the suction chamber 25 is introduced into the compression chamber 10*b* in the cylinder bore 10*a* and is compressed and, then, the high-pressure coolant is discharged into the discharge chamber 26. In this case, the angle of inclination of the swash plate 22 and the stroke of the piston 23 undergo a change depending upon a pressure difference (Pc−Ps) between the crank chamber pressure Pc controlled by the control valve 40 based on the temperature in the compartment and the suction pressure Ps, and the discharge capacity is controlled. That is, the angle of inclination of the swash plate 22 decreases with an increase in the pressure difference (Pc−Ps), whereby the stroke of the piston 23 decreases and the discharge capacity decreases. On the other hand, the angle of inclination of the swash plate 23 increases with a decrease in the pressure difference (Pc−Ps), whereby the stroke of the piston 23 increases and the discharge capacity increases.

Figure 2:
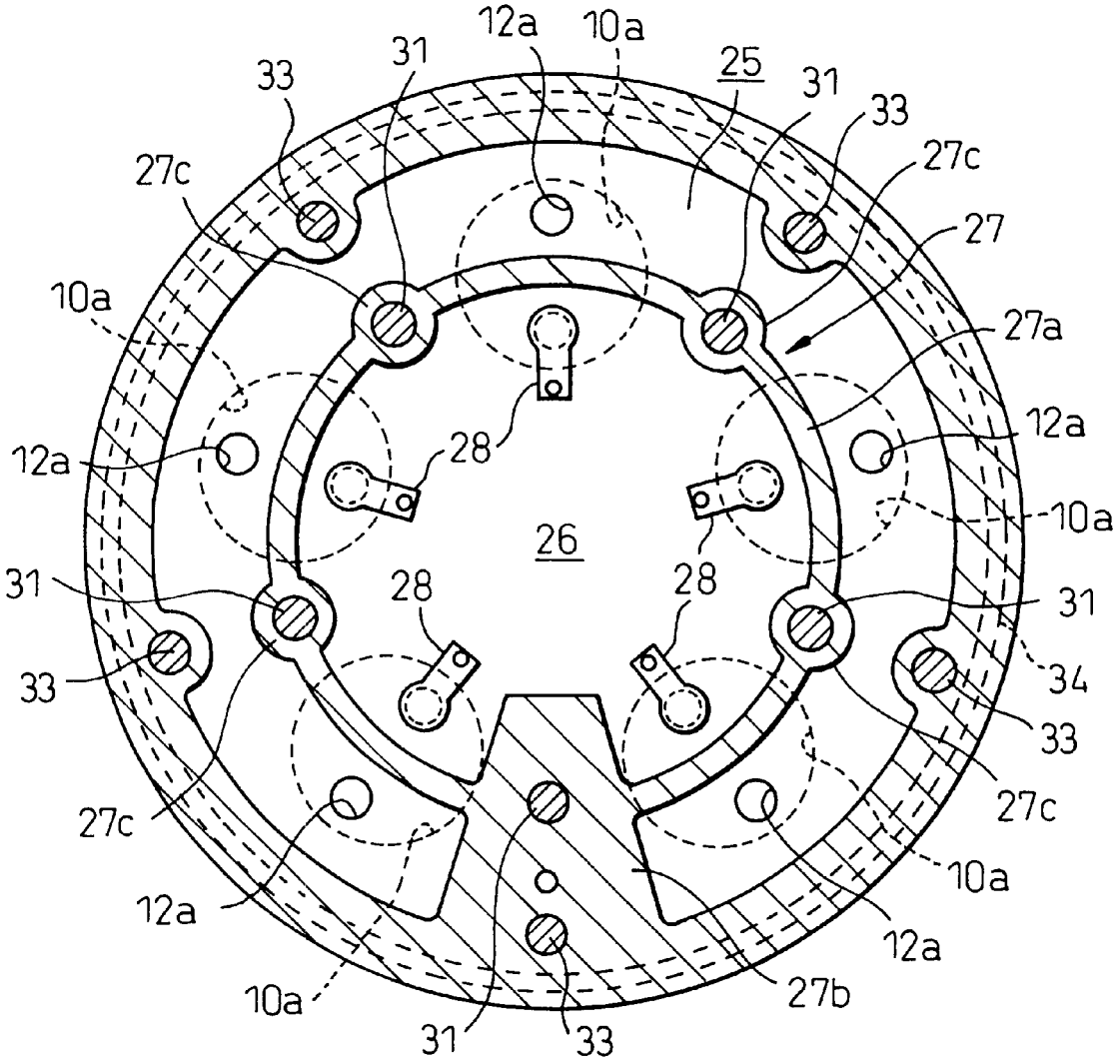
FIG. 2 is a cross-sectional view of the compressor of FIG. 1, taken along the line II—II in FIG. 1.

Referring to FIG. 2, the characteristic constitution of the compressor 1 is that the cylinder block 10 and the rear housing 13 are fastened together by bolts 31 extending in the separating wall 27 that separates the suction chamber 25 from the discharge chamber 26, the bolts 31 having heads 31*a* on the cylinder block 10 in the crank chamber 14 and threaded ends engaged in corresponding threaded holes in the separating wall 27. The separating wall 27 has a nearly ring-like annular portion 27*a* that defines the suction chamber 25 on the outer side and defines the discharge chamber 26 on the inner side, and a nearly trapezoidal portion 27*b* which extends from the outer peripheral side wall of the rear housing 13 toward the inside up to the nearly ring-like annular portion 27*a*, while accommodating the control valve 40 therein. The nearly ring-like annular portion 27*a* and the nearly trapezoidal portion 27*b* axially extend forward from the rear end wall of the rear housing 13. The nearly ring-like annular portion 27*a* has four thick wall bolt-insertion portions 27*c* in which the bolts 31 are inserted. The thick wall bolt-insertion portions 27*c* of the nearly ring-like annular portion 27*a* and the nearly trapezoidal portion 27*b* are arranged at an uniform circumferential distance. Bolt holes 32 penetrate the thick wall bolt-insertion portions 27*c* and the nearly trapezoidal portion 27*b* of the nearly ring-like annular portion 27*a* and the corresponding portions of the cylinder block 10 so as to extend from the front end surface of the cylinder block 10, through the cylinder block 10 and the valve plate 12, to the separating wall 27. The bolt holes 32 have accommodation portions 32*a* in the front end surface of the cylinder block 10, permitting the heads 31*a* of the bolts 31 to be completely accommodated in the cylinder block 10.

Further, the front housing 11, the cylinder block 10 and the rear housing 13 are fastened together by outer bolts 33 that extend through the cylinder block 10 at the peripheral regions on the outer side of the cylinder bores 10*a*. An O-ring 34 is interposed between the rear end surface of the cylinder block 10 and the front end surface of the rear housing 13 at a position on the outer side of the valve plate 12 and on the outer side of the outer bolts 33.

In this compressor 1, no gasket, as a sealing member, is interposed between the rear end surface of the cylinder block 10 and the front end surface of the valve plate 12, or between the front end surface of the rear housing 13 and the rear end surface of the valve plate 12.

In the thus constituted compressor 1, when the rotation of the engine (not shown) as a drive source is transmitted to the drive shaft 15 through the electromagnetic clutch, the swash plate 22 is rotated in synchronism with the rotary support member 21 at a predetermined angle of inclination accompanying the rotation of the drive shaft 15. The rotational motion of the swash plate 22 is converted into the back-and-forth reciprocal motion of the piston 23 via the pair of shoes 24 and 24, whereby the piston 23 reciprocates in the cylinder bore 10*a*. Then, the low-pressure coolant fed back from the accumulator into the suction chamber 25, is sucked into the compression chamber 10*b* in the cylinder bore 10*a* and is compressed and is, then, discharged as a high-pressure coolant into the discharge chamber 26. The high-pressure coolant discharged into the discharge chamber 26 is delivered to the gas cooler.

In this case, in the refrigerating device of the embodiment of the present invention using $CO_2$ as the coolant, the compressor discharges the gas at a supercritical pressure of the coolant (about 10 MPa). Thus, the discharge pressure is so high that the internal leakage is apt to occur.

Concerning this point in the compressor 1 of this embodiment, the cylinder block 10 and the rear housing 13 are fastened together by bolts 31 that extend in the separating wall 27 of the rear housing 13. Therefore, the fastening force of bolts 31 are directly exerted on the separating wall 27, enabling the end surface of the separating wall 27 to be reliably forced to the cylinder block 10. This enhances sealing performance at the end surface of the separating wall 27 and, hence, enhances sealing performance between the suction chamber 25 and the discharge chamber 26 separated by the separating wall 27. Even when $CO_2$ is used as the coolant, therefore, the compressor 1 decreases internal leakage in that the high-pressure coolant flows into the suction chamber 25 through the end surface of the separating wall 27 as it is compressed in the compression chamber 10*b* in the cylinder bore 10*a* by the reciprocal motion of the piston 23 in the cylinder bore 10*a* and is discharged into the discharge chamber 26. This, accordingly, suppresses a drop in the performance of the compressor 1 caused by internal leakage.

In this embodiment, further, the discharge chamber 26 is formed inside the separating wall 27 that is reliably sealed by bolts 31, preventing the high-pressure coolant in the discharge chamber 26 from leaking to the outer side through the separating wall 27 and, hence, suppressing not only internal leakage but also reliably preventing the high-pressure coolant from leaking to the outer side of the compressor 1. This makes it possible to omit not only the gasket that maintains sealing on the surface where the cylinder block 10 and the rear housing 13 are abutted to each other but, depending upon the cases, also the bolts that are used for maintaining the sealing between the outer peripheral side walls of the cylinder block 10 and the rear housing 13. Omission of these parts makes it possible to decrease the cost.

Further, the cylinder block 10 and the rear housing 13 are fastened together by bolts 31 having heads 31*a* located on the side of the crank chamber 14. Accordingly, the high-pressure coolant that may leak from the end surface of the separating wall 27 through bolts 31 and bolts holes 32 stays in the crank chamber 14 which is a sealed space formed by the shaft-sealing device 16, and does not leak to the outside of the compressor 1. Therefore, even if washers for maintaining the sealing between the bolts 31 and the bolt holes 32 are omitted, the high-pressure coolant does not leak to the outside of the compressor 1. Omission of the washers makes it possible to decrease the cost.

Though the above-mentioned embodiment is explained with reference to a supercritical cycle refrigerating device using carbon dioxide as the coolant, the compressor of the present invention can be further adapted to a subcritical cycle refrigerating device using freon-type coolant as a coolant, as a matter of course.

Though the above-mentioned embodiment is explained with reference to the variable capacity type compressor in which single-headed pistons are engaged to the swash plate by a pair of front and rear shoes, it is of course allowable to use double-headed pistons, or in which the single-headed pistons are engaged with the swash plate via a rod, or to apply the invention to a fixed-capacity type compressor.

What is claimed is:

1. A piston-type compressor comprising:

a cylinder block having cylinder bores;

a housing joined to said cylinder block and having an interior and a separating wall to divide said interior into a suction chamber and a discharge chamber;

pistons reciprocatingly arranged in said cylinder bores;

a rotatable drive shaft;

a compression mechanism rotatable with said shaft to cause said pistons to reciprocate in said cylinder bores so that a low pressure coolant is sucked from said suction chamber into said cylinder bores and a high pressure coolant is discharged from said cylinder bores into said discharge chamber; and bolts extending in said separating wall of said housing to fasten said cylinder block and said housing together.

2. A compressor according to claim 1, wherein said separating wall is shaped in an annular form, said discharge chamber being formed inside the said separating wall, said suction chamber being formed outside said separating wall.

3. A compressor according to claim 2, wherein said housing comprises a front housing joined to a front side of the cylinder block and rotatably supporting said drive shaft, and a rear housing joined to a rear side of the cylinder block and having said separating wall, said front housing and said cylinder block forming a crank chamber therein, each of said bolts having a head arranged on said cylinder block in said crank chamber and a threaded end engaged in a corresponding threaded hole in the separating wall of said rear housing.

4. A compressor according to claim 3, wherein said piston is a single-headed piston, said compression mechanism including a swash plate supported by said drive shaft and arranged in said crank chamber so that said swash plate is inclined with respect to said drive shaft and rotatable with said drive shaft.

5. A compressor according to claim 3, further comprising a valve plate between said cylinder block and said rear housing, said bolts extending through said valve plate.

6. A compressor according to claim 3, wherein said separating wall has thick wall portions along the annular form thereof, said threaded holes being arranged in said thick wall portions.

7. A compressor according to claim 6, further comprising a second set of bolts extending from said front housing to said rear housing to connect said front housing, said cylinder block and said rear housing together.

8. A compressor according to claim 7, wherein said first set of bolts are arranged at a first angular pitch, and said second set of bolts are arranged at a second angular pitch on the radially outer side of said first set of bolts.

9. A compressor according to claim 1, wherein the coolant is discharged at a supercritical pressure of the coolant.

10. A compressor according to claim 9, wherein the coolant is carbon dioxide.

* * * * *